US005092690A

United States Patent [19]

Grimm et al.

[11] Patent Number: 5,092,690

[45] Date of Patent: Mar. 3, 1992

[54] PORTABLE PRINTER

[75] Inventors: Thomas R. Grimm, Troy; Erik A. Treszoks, Temple; Luther L. Oliver, Austin; Sam Vinson, Temple; Jose I. Rodriguez, Garland; Donald J. Arndt, Georgetown; Mark A. Rendon, Belton; Dan Dodson, Temple, all of Tex.

[73] Assignee: Texas Instruments Incorporated, Dallas, Tex.

[21] Appl. No.: 590,566

[22] Filed: Sep. 28, 1990

Related U.S. Application Data

[63] Continuation of Ser. No. 349,361, May 9, 1989, abandoned.

[51] Int. Cl.[5] ..... B41J 3/02

[52] U.S. Cl. ..... 400/126; 400/616.3; 400/605; 400/642; 226/196; 242/75.3; 346/75; 474/101

[58] Field of Search ..... 400/616-616.3, 400/613-613.3, 605, 611, 614.1, 637, 637.2, 638-639, 639.1, 648, 659, 645, 634, 636, 643, 642, 645.4, 645.5, 647.1, 571, 126; 474/101, 117, 138, 190-192; 226/196, 198; 346/75; 242/75.3, 67.3 R

[56] References Cited

U.S. PATENT DOCUMENTS

| | | | |
|---|---|---|---|
| 1,164,622 | 12/1915 | Anderson | 400/645.4 |
| 1,387,842 | 8/1921 | Edwards | 400/642 |
| 1,557,510 | 10/1925 | West | 400/638 |
| 3,107,836 | 10/1963 | Van't Veld | 226/196 |
| 3,414,106 | 12/1968 | Moran et al. | 400/616.1 |
| 3,874,493 | 4/1975 | Boyd . | |
| 3,966,108 | 6/1976 | Boyd | 226/196 |
| 3,972,460 | 8/1976 | Kesinger et al. | 400/636 |
| 4,277,034 | 7/1981 | Buzzell | 242/67.3 R |
| 4,389,008 | 6/1983 | Boyanowski et al. | 242/75.3 R |
| 4,525,087 | 6/1985 | Cardona et al. | 400/613.2 |
| 4,619,388 | 10/1986 | Ono et al. | 400/616.3 |
| 4,734,868 | 3/1988 | DeLacy | 400/616.1 |
| 4,775,254 | 10/1988 | Nakao et al. | 400/708 |
| 4,806,035 | 2/1989 | Maeda | 400/642 |
| 4,822,192 | 4/1989 | Morita | 400/616.3 |
| 4,826,335 | 5/1989 | Kimura | 400/616.3 |
| 4,865,478 | 9/1989 | Chan et al. | 400/616.3 |
| 4,867,363 | 9/1989 | Wood et al. | 400/616.3 |

FOREIGN PATENT DOCUMENTS

| | | | |
|---|---|---|---|
| 0187196 | 7/1986 | European Pat. Off. | 400/571 |
| 2503642 | 8/1976 | Fed. Rep. of Germany | 400/643 |
| 0135541 | 10/1979 | Japan | 400/636 |
| 0087978 | 6/1982 | Japan | 400/613.1 |
| 0208343 | 12/1982 | Japan | 474/101 |
| 0091076 | 5/1984 | Japan | 400/636 |
| 0183451 | 12/1985 | Japan | 400/616.3 |
| 0164870 | 7/1986 | Japan | 400/643 |
| 193122 | 9/1937 | Switzerland | 226/196 |

OTHER PUBLICATIONS

"Bidirectional Printer Carriage", Darwin et al., IBM Tech. Disclosure Bulletin, vol. 15, No. 1, 6/72, p. 157.

"Continuous Form Paper Alignment & Registration", IBM Tech. Disclosure Bulletin, vol. 22, Nol 5, 10/79, p. 1751-1752.

*Primary Examiner*—Eugene H. Eickholt

*Attorney, Agent, or Firm*—Richard L. Donaldson; William E. Hiller; L. Joy Griebenow

[57] ABSTRACT

A portable printer including paper feed apparatus for utilizing sheet, roll or continuous form paper. The paper feed apparatus having pin feed drive members and friction rollers for feeding all three forms of paper. The printer also includes apparatus for selecting printing different character pitches to reduce the memory capacity required. A method is provided for operating the printer to obtain alignment of the paper feed drive motor prior to printing.

6 Claims, 3 Drawing Sheets

FIG. 7
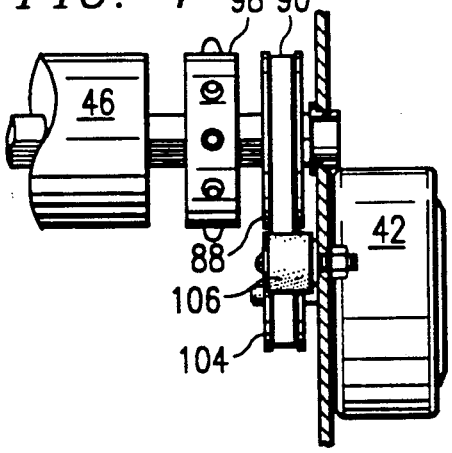
FIG. 8
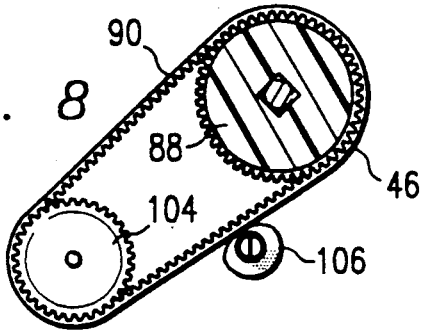
FIG. 9
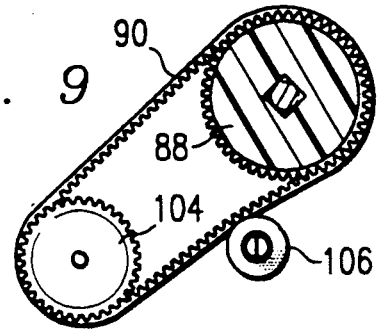
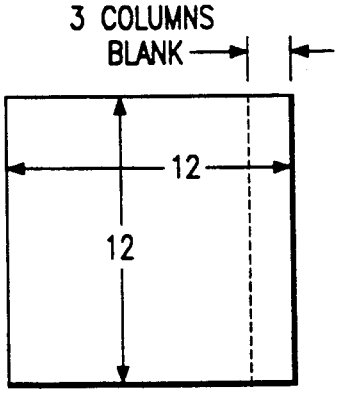
FIG. 11
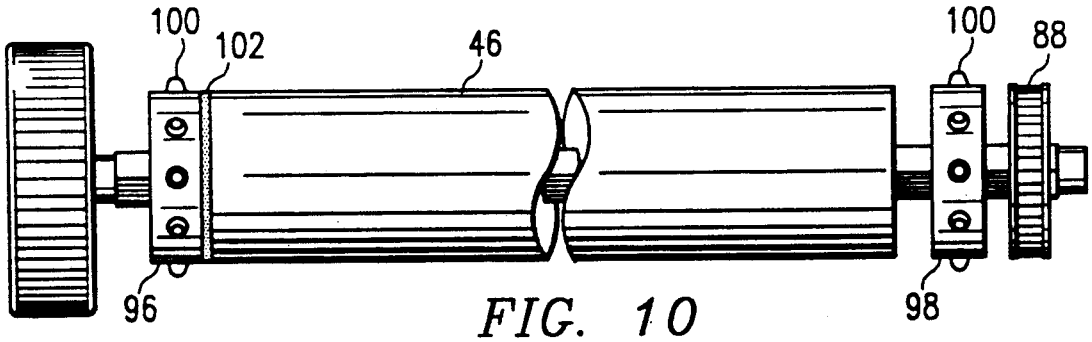
FIG. 10
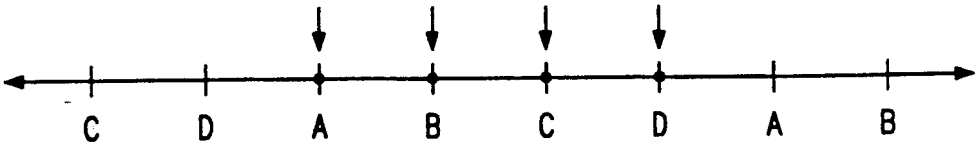
FIG. 12

PORTABLE PRINTER

This application is a continuation, of application Ser. No. 07/349,361, filed May 9, 1989 and now abandoned.

FIELD OF THE INVENTION

This invention relates generally to printers that are operable in connection with a processor such as a terminal or computer. More particularly, but not by way of limitation, this invention relates to an improved, light weight, portable printer such as may be used in conjunction with a portable computer or terminal.

BACKGROUND OF THE INVENTION

Small, portable printers for use with computers have become very desirable with the advent of portable computers such as the "lap top" computers and with the advent of portable terminals. Naturally, and since such printers are intended to be portable, it is highly desirable that they be as small and light as possible. Furthermore, the computer business is extremely competitive and the reduction in sales price by price saving during manufacture of the printer is of major significance.

In addition to the foregoing, the advance in the printer art has demanded that such printers be more and more accurate and that they produce not only high quality characters, but that the graphics produced thereby have very high best definition.

For the most part, the portable printers have been of the dot matrix type which includes mechanical, pin-type printers, thermal printers, or ink jet printers. Among these, an ink jet printer, referred to as a "Think Jet" manufactured by Hewlett Packard has proved to be very successful since it is light weight, relatively low in cost, and totally portable.

In ink jet printers, the letters or graphics are formed by the disposition of ink that is sprayed or spurted onto the paper. There is no mechanical impact such as is true of the mechanical pin-type printers. Accordingly, it has been possible to eliminate the need for a heavy, large platen that is required to absorb the mechanical impact that occurs during the transfer of the characters to paper.

As a result of the accuracy demanded, the printers have certain problems in common. For example, accuracy and repeatability of paper feed when advancing the paper is required. Paper feed accuracy may be affected if there is backlash in the mechanism driving the paper through the printer. Also, a problem that has to be considered in the design of such printers is the necessity for locating the position of the print head vertically with respect to the paper feed. For example, to avoid printing into a lower or upper margin, or, printing over the perforations in continuous feed forms, it is necessary to know where the print head is located vertically so that the printer will skip to the next page or form and begin printing at the appropriate position.

One other problem encountered in the manufacture of portable printers, is the weight of the printer itself. It is highly desirable to reduce all stresses within the printer to be able to reduce the number of structural members that are required to provide a rigid chassis for supporting the paper, paper advance mechanism and the print head and to maintain those devices in their relative positions to maintain printer accuracy.

In addition to the foregoing problems, it is highly desirable in a portable printer to be able to print on individual sheets, rolled paper or on continuous feed form paper. Manifestly, such an arrangement can be provided, but the complexity, weight and cost of such mechanism must be suitable for use in a portable printer.

The present printer includes a data processor and a data storage for storing a plurality of characters. In previously developed printers, it has been known to store data for a character for a plurality of fonts or pitches, with separate storage being provided for the characters in each font or pitch. For example, for each font, data for 256 characters might be stored, with as many as four storage locations required to store data for four different fonts or pitches. This has required a substantial amount of memory capability for previously developed printers. This has caused increased unit cost and unit size due to the increased RAM or ROM storage requirements for prior devices.

SUMMARY OF THE INVENTION

In one aspect, this invention contemplates an improved paper feed apparatus for a processor driven printer that includes a drive motor responsive to the processor and includes a case that has feed and delivery slots for the paper formed therein. The apparatus includes a cylindrical platen that is operably connected to the drive motor; an elongated paper guide member that is disposed in juxtaposition with the lower portion of the platen forming a paper guide slot therebetween; a plurality of friction rollers, arranged to hold the paper in tight engagement with the platen for movement of the paper through the guide slot; a paper roll receptacle extending generally parallel to the guide slot for holding a roll of paper wherein a free end of the paper can be fed into the guide slot; and a pin-feed drive member located on and driven with the platen and located in spaced relationship. Each of the drive members having a plurality of circumferentially spaced, radially projecting pins thereon for location in holes provided along each edge of continuous form feed paper whereby roll, sheet and continuous form feed paper can be used in the printer.

In another aspect, this invention contemplates a backlash free drive system for the paper feed that includes a cogged drive pulley mounted on the drive shaft of the stepping motor and rotatable therewith; a cogged driven pulley mounted on a cylindrical platen and rotatable therewith and positioned in alignment with the drive pulley; a resilient, continuous drive belt having a cogged inner side and a smooth outer side. The belt being arranged to drivingly connect the pulleys. The apparatus also includes a resilient idler pulley mounted on the chassis and located between the pulleys with it periphery yieldingly engaging the smooth outer side of the belt for urging the belt into tighter, driving engagement with the pulleys thereby eliminating slack in the drive system.

In accordance with yet another aspect of the invention, a plurality of different character pitches may be printed by the present printer, while requiring storage of only a single set of character cells, by the selective use of different groups of the character cell data.

The phase intelligence system incorporated into the printer of the present invention allows for the physical position of either of the movable printing elements to be brought into phase with their drive motors and the processor prior to the beginning of printing operations.

TECHNICAL ADVANTAGES

One technical advantage of this invention is the provision of a portable printer having an improved paper feed mechanism that avoids the problem of backlash in the paper drive system.

Another technical advantage of the invention is the provision of a printer that can feed three different types of paper without change.

A further technical advantage of the printer of the present invention is the incorporation of a phase intelligence system which improves the print quality of the first line of print after the printer has been idle for a predetermined period of time.

Still another technical advantage of the printer of this invention is the reduction of memory capacity required since the storage of only one font is required.

BRIEF DESCRIPTION OF THE DRAWING

The foregoing additional objectives and advantages of the invention will become more apparent as the following detailed description is read in conjunction with the accompanying drawing wherein like reference characters denote like parts in all views and wherein:

FIG. 7 is a view illustrating a portion of the paper drive mechanism in elevation that is used to eliminate slack from the drive system;

FIG. 8 is a view, partially in elevation and partially in cross-section, taken generally along the line 8—8 of FIG. 7;

FIG. 9 is a view similar to FIG. 8, but illustrating the parts in another operating position;

FIG. 10 illustrates in more detail the structure of a platen used in the printer that is also constructed in accordance with the invention;

FIG. 11 is a graphical depiction of a character cell used to enable the printing of different character pitches in accordance with the invention; and FIG. 12 is a graphical illustration of the operation of the phase intelligence system of the present invention.

THE PAPER FEED SYSTEM

Figure 1:
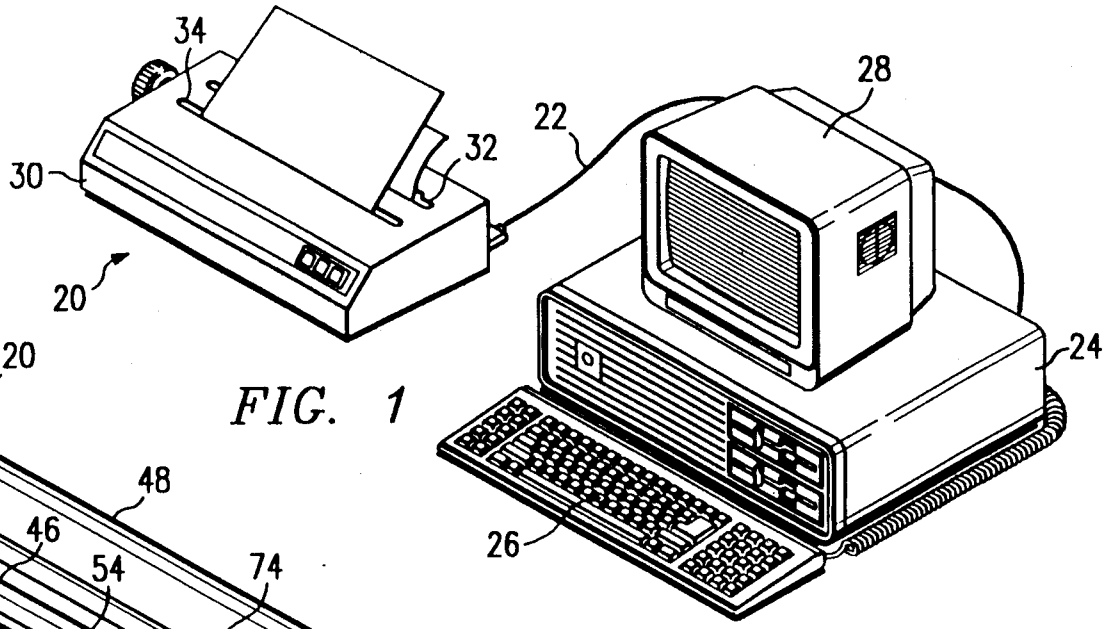
FIG. 1 is a view of a computer terminal containing a processor connected to a portable printer that is constructed in accordance with the invention.

Referring to the drawing and to FIG. 1 in particular, shown therein and generally designated by the reference character 20 is a portable printer that is constructed in accordance with the invention. The printer 20 is connected by an appropriate cable 22 with a processor 24 that is illustrated as including a key board 26 and a monitor 28. Manifestly, the processor 24 may either be a computer or a terminal so long as it is provided with appropriate software for driving the printer 20. The printer 20 includes a case 30 having a paper "in" slot 32 and a paper "out" slot 34 formed therein.

Figure 2:
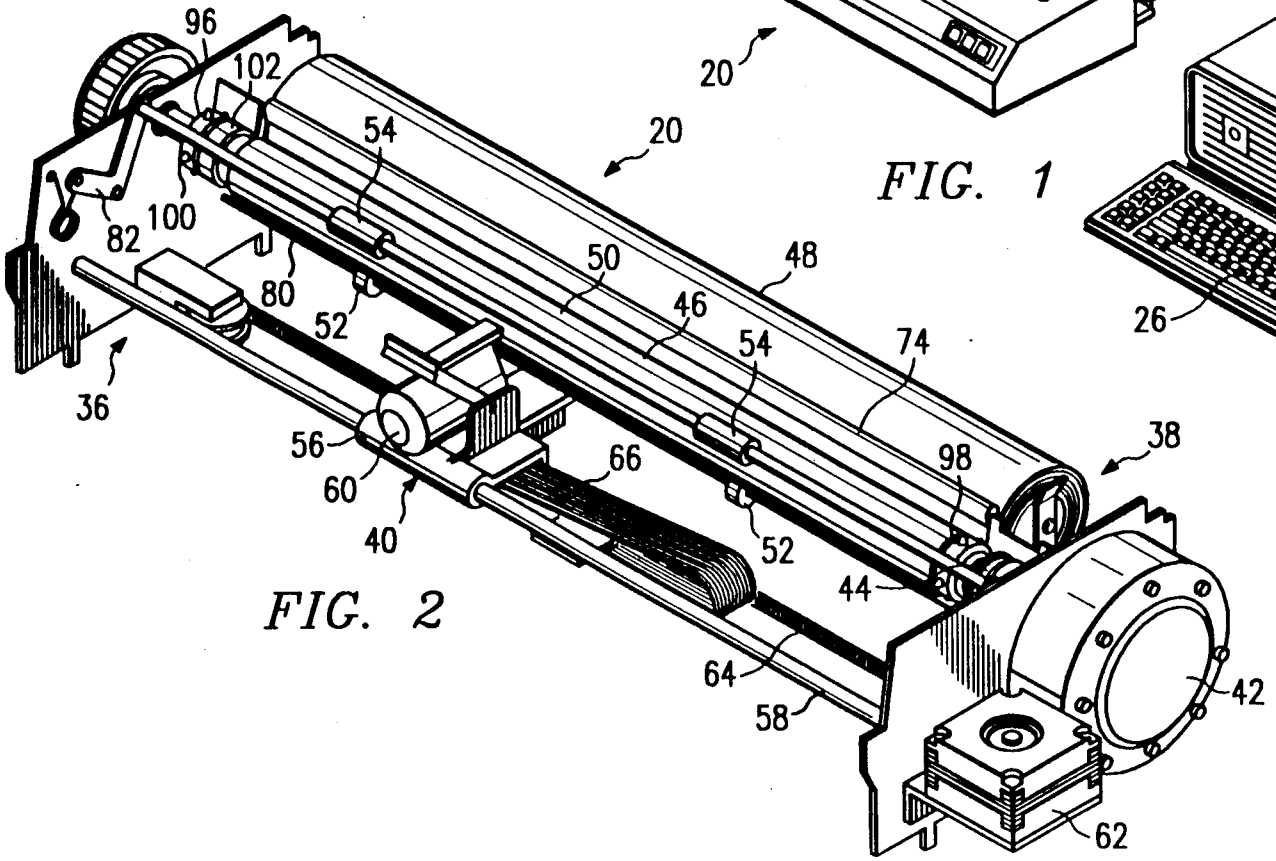
FIG. 2 is an isometric view of the internal components of the printer of FIG. 1 removed from the case.

Referring to FIG. 2, the case 30 has been removed from the printer 20 disclosing a printer chassis generally designated by the reference character 36, a printer feed mechanism that is generally designated by the reference character 38 and a printer head assembly generally designated by the reference character 40.

The paper feed system 38 includes a paper feed drive motor 42 which, through a belt drive 44 drives platen 46. As illustrated therein, a roll of paper 48 is fed between the platen 46 and a paper guide member 50. The paper is held in tight engagement with the platen 46 by friction rollers 52 and bail rollers 54. As will be described more completely hereinafter, the printer 20 will also handle sheet paper as well as tractor or pin feed paper.

The printer head assembly 40 includes a carriage 56 that is slideable on a carriage bar or rod 58 that extends transversely across the printer 20. The carriage 56 carries an ink cartridge 60 which is appropriately arranged to deliver spurts of ink onto the surface of the paper to form the desired characters.

For the purpose of driving the print head assembly 40 across the printer 20, a motor 62 is mounted on one end thereof and drives a cog belt 64 carrying the printer head assembly 40 back and forth across the printer 20. The intelligence to direct the printer head assembly 40 to the appropriate position on the paper and to determine which characters are to be printed is transmitted through the cable 22. A conductor strap 66 is provided through which appropriate signals are transmitted to determine which character will be formed by the printer head assembly 40. The strap 66 is operably connected to the cable 22 through appropriate control circuits (not shown).

The ability of the printer to print on sheets, roll paper, and on continuous form feed paper will be more easily understood when viewed with the illustrations of FIGS. 3 through 6.

Figure 3:
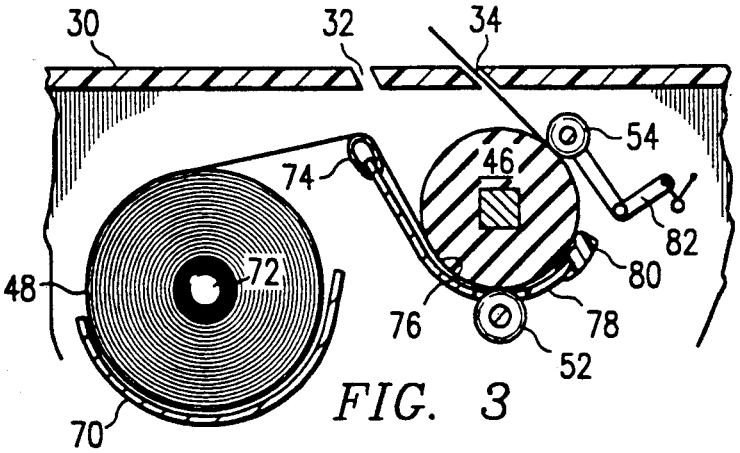
FIG. 3 is a cross-sectional view taken through the printer illustrating the roll paper feed mechanism of the printer of FIG. 2.
Figure 4:
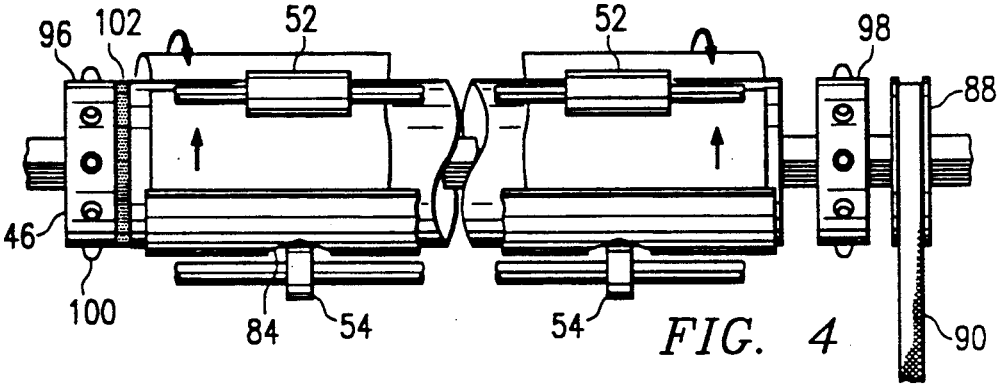
FIG. 4 is a view taken transverse to the cross-sectional view of FIG. 3 illustrating the drive mechanism used for feeding the paper.

FIGS. 3 and 4 illustrate the mechanism for handling the paper rolls as it is feed through the printer. As shown therein, a paper roll 48 is located in a roll paper receiving member 70 which is arranged with a pivot 72 which permits the paper to revolve and be fed therefrom. The paper is led off the role 48 over a device which may be referred to as a dancer spring 74 and into a paper guide slot 76 formed between platen 46 and a paper guide member 78. The paper then continues upwardly past an elongated spring 80 which serves to hold the paper against the platen 46 and in position to be printed upon. The paper continues upwardly past bail 82 having the rollers 52 located thereon. The paper passes out of the case 30 through the paper "out slot" 32.

As can be seen more clearly in FIG. 4, the guide member 78 is provided with spaced openings 84 that receive friction rollers 52 to hold the paper securely against the platen 46 as it is fed through the slot 76.

On the end of the platen 46 there is mounted a drive pulley 88 which is driven through the belt 90 by the motor 42. The motor to platen mechanism is illustrated more fully in connection with FIGS. 7 through 9 which will be described hereinafter.

The dancer spring 74 which is an elongated plastic member formed in a generally U-shape configuration, is slipped over the upper edge of the paper guide member 78. It will be noted that the dancer spring 74 has an inside dimension greater than the thickness of the guide member 78, and consequently can move toward and away from the paper roll 48 as the paper is drawn thereover. The arrangement aids in maintaining tension on the roll 48 and prevents inadvertent slack in the paper while maintaining the feed at a very easy and smooth rate.

When it is desired to use the roll paper, the roll of paper 48 is placed in the paper receiving member 70 and arranged with respect to the pivot 72 so that the paper roll can rotate. The end of the paper is then fed from the roll over the dancer spring 74 through the slot 76, past the friction rollers 52,52 and the rollers 54,54 on the bail 82 upwardly and outwardly through the outlet slot 34 in the case 30. As the paper drive shaft 46 is rotated by the motor 42, paper is drawn off the roll 48 since it is drivingly retained between the friction and bail rollers 52 and 54, respectively, and the platen 46.

Figure 5:
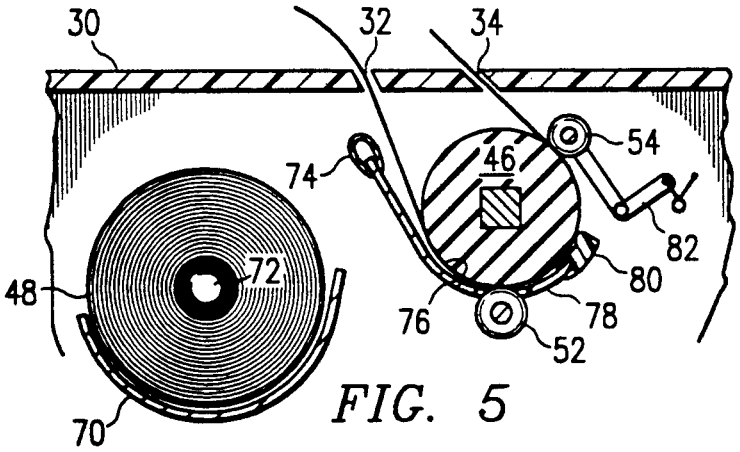
FIG. 5 is a view similar to FIG. 3, but illustrating the printer when used to feed either sheet or continuous form feed paper.
Figure 6:
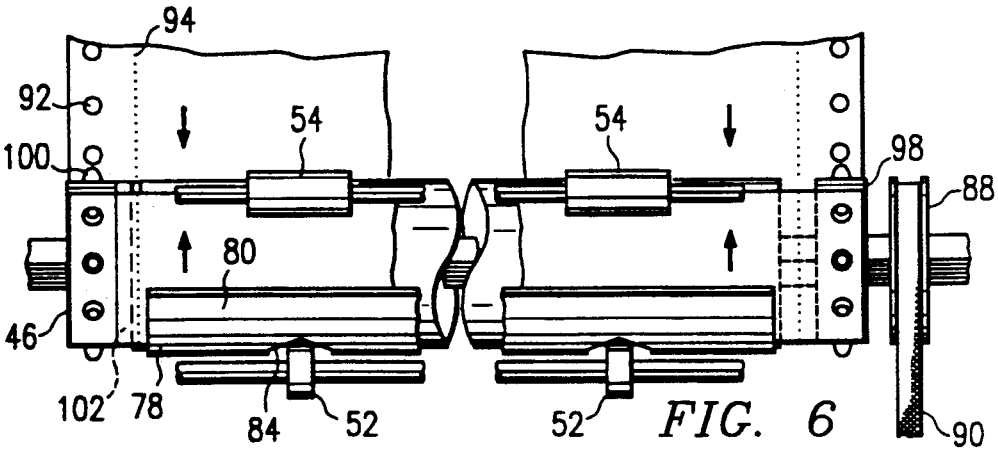
FIG. 6 is a view similar to FIG. 4, but illustrating use of the apparatus when feeding continuous form feed paper.

When it is desired to feed sheet paper through the printer 20, the paper is inserted through the inlet slot 32 in the case 30 as shown in FIG. 5, past the dancer spring 74 through the guide slot 76, past the friction rollers 52 and the idlers 54 on the bail 82, and upwardly and outwardly through the outlet slot 34 in the case 30. The paper roll 48 may remain in the roll receiving member 70 in an inactive status. The feed of the sheet paper is accomplished simply by rotating the platen 46.

When continuous form feed paper is to be utilized, the end of the paper is introduced as described with respect to the sheet paper drive (except that the paper requires the greater width of the slot) and as shown in FIG. 5. Continuous form feed paper is traditionally provided with a plurality of spaced holes 92 that extend along each side of the paper just outside of a perforated line 94 which defines the tear away edges of the paper.

As shown in FIG. 4 and more clearly in FIG. 10, the platen 46 includes a pair of spaced pin drive members 96 and 98. The pin drive member 96 is fixed on the shaft and rotates with the paper feed drive member 46. It cannot move laterally with respect to the feed drive member 46. On the other hand, the pin feed member 98 is fixed to and rotates with the shaft of the platen 46, but is arranged to move laterally along the member 46.

In the past, printers for feeding continuous form feed paper, sometimes referred to as tractor feed, utilized the multiplicity of pins 100 which extend radially from the members 96 and 98 through the holes 92 in the paper for the purpose of driving the paper through the printer. In the printer 20, the pin feed members 96 and 98 are primarily used for the purpose of alignment of the continuous form feed paper since the friction members 52 and the platen 46 serve to frictionally drive the paper through the printer 20.

The platen 46 is also provided with a felt washer 102 that is located adjacent to the pin drive wheel 96. The felt washer 102 will lie along one side of the edge of the paper when sheet or roll paper is utilized and is provided for the purpose of absorbing a squirt of ink that is delivered by the ink jet head prior to its starting to print. The purpose of the squirt of ink is to clear the ports in the print head. When used with the continuous form feed paper, the felt washer 102 is disposed behind the paper, but will be outside of the perforation lines 94 so that the ink squirted thereon will be removed when the perforated edge is removed.

As previously mentioned, FIGS. 7 through 9 illustrate the drive utilized for advancing the paper through the printer 20. As illustrated in FIG. 7, the drive motor 42 has a cog pulley 104 mounted thereon which engages the belt 90 for driving the cog pulley 88 located on the end of the platen 46.

The cog belt 90 has the cogs therein disposed on the inner surface for engagement with the pulleys 88 and 104. The exterior is generally smooth. As would be expected, the belt 90 is composed of a resilient material and as such is subjected to stretching, particularly with increasing temperatures. Also, it is most desirable, if not absolutely necessary, that no slack or back-lash exist in the belt 90 which could cause a variation in the positioning of the platen 46.

The difficulty of avoiding slack or back-lash will be appreciated when it is considered that manufacturing tolerances on the pulleys 88 and 104, on the length of the drive belt 90, and during manufacturing on the spacing between the motor 42 and the platen drive 46 can be additive and, thus, vary the required belt length substantially. Accordingly, a substantial amount of slack could occur in belt 90 which would result in poor printer performance.

To alleviate the tolerance and temperature variations and the difficulty of adjusting and readjusting the tension in the belt 90, an idler 106 is rotatably mounted on the end-frame member 108. The idler 106 is mounted so that its normal radius would extend past a line tangent to both of the pulleys 88 and 104. To accommodate this, the idler 106 is constructed from a very resilient material having a durometer or hardness of Endur-C. Accordingly, the idler 106 deforms where it engages the belt 90 and, yet, resiliently urges the belt 90 toward a position to eliminate any slack that could occur therein.

FIG. 9 illustrates the configuration of the idler 106 in the event that the belt 90 becomes longer or is improperly adjusted. It can be seen therein that the idler 106 continues to urge the belt 90 inwardly thus maintaining its tightness.

The use of the resilient idler 106 eliminates the need for a spring loaded arm or other device for maintaining force on the belt 90. It also eliminates the need for careful adjustment and the maintenance of very close tolerances that might otherwise be required to assure printer accuracy. The use of the idler 106 also results in substantial saving, both from the cost of the idler itself and assembly time required in assembling and adjusting the relative positions between the motor 42 and the platen 46. From the foregoing it can be seen that the drive arrangement utilized in the printer 20 also provides a reduction in weight cost and increase in the accuracy and durability of the printer.

VARIABLE CHARACTER PITCH SYSTEM

Although not shown, the printer 20 includes a data storage element which may be ROM, RAM or other conventional type. The present invention provides a system for reducing RAM or ROM storage requirements and thereby reducing the required unit cost and unit size of a printer. In accordance with the invention, only one storage for a single font is required, with the dot patterns being manipulated by the system to produce several densities from the single stored pattern. The present invention can thus produce densities from a single 12×12 storage cell of 5 cpi, 6 cpi, 10 cpi and 12 cpi, for example.

FIG. 11 illustrates a cell character formed in a 12×12 matrix configuration. The cell character comprises 12 horizontally disposed vertical columns and 12 horizontal lines. Data corresponding to the 12×12 cell character are stored in suitable memory locations in the printer memory. It will be understood that the data may be stored in any desired configuration within the storage, which may comprise RAM or ROM storage, so long as it is possible to read out the data in the illustrated matrix configuration.

It will be understood that character cells as shown in FIG. 11 will be stored for each desired character. However, as will be subsequently described, data for only a single character cell may be manipulated to print the character in a plurality of different pitches. For example, for an 8½"×11" piece of paper, if a 10 pitch is required, 10 characters per inch will be printed across the page. Assuming 8 inches of horizontal space on the paper, 80 cell characters of the type shown in FIG. 11 would be utilized. In operation of the present invention, when 10 pitch is utilized, the data stored for the desired cell character is pulled from memory and is used to control the operation of the printer to print the desired character. Thus in the case of 10 pitch, all the data stored in the character cells are printed and 80 characters could be printed across the page.

An important aspect of the invention is that, as shown in FIG. 11, the last three vertical columns of each cell character are blank or thus contain no data. In the case of 10 pitch, this lack of data enables adjacent characters to be properly spaced from one another.

Another important aspect of the invention is that the cell character shown in FIG. 11 may be manipulated to allow the printing of different pitches using the same printer head motor speed. Assuming that it is now desired to change from 10 pitch and to print at 12 pitch, the system "throws away" or does not consider or use the last two data columns of the character cell. Since these last two data columns are blank, no resolution is lost, but the spacing between the adjacent characters is decreased to provide more characters across the page to provide 12 pitch. Because the third to last data column is blank, using 12 pitch, there is still sufficient spacing between the adjacent characters using this technique.

If it is desired to print at 6 pitch, again the last two data columns are not utilized, but each of the first 10 columns which do contain data are doubled or used twice. Specifically, the first column of data would first be printed, and the printer head moved to the next character position, whereupon the first column of data is again reprinted. The printer head is then moved to the next location, and the data associated with the second column is printed. The printer head is moved to the fourth position, at which time the data in the second column is again reprinted. By reprinting or doubling the data stored in the vertical columns in this manner, and by "throwing out" or not using the data in the last two data columns, the printer may use the same motor speed and control algorithms while printing out at 6 pitch.

If it is desired to print at 5 pitch using the invention, all 12 data columns are utilized and doubled. In this manner, the amount of space used is doubled, and the resulting spacing between the characters is doubled from that of 10 pitch as previously described.

In the embodiments previously noted, at least one vertical column used in printing is blank, thereby allowing proper spacing between the characters. If it is desired to print designs such as lines or the like, only two data columns stored in the memory may be left blank in the cell characters shown in FIG. 11, as it may be desirable in some cases to join the lines, and thus no spacing between printed characters is required.

It may thus be seen that the present invention provides the advantage of printing at different pitches with the same motor speed without a substantial requirement of memory for the storage of data relating to different pitches.

PRINTER PHASE INTELLIGENCE SYSTEM

A further technical advantage of the printer constructed according to the teachings of the present invention is the incorporation of a phase intelligence system which improves the print quality of the first line of print after the printer 20 has been idle for a predetermined period of time. The feed drive motor 42 and the carriage drive motor 62 may both comprise stepper motors controlled by the processor 24 through the transmission of phase signals. As described previously, the feed drive motor 42 operates to advance the platen 46 in extremely small steps. Similarly, the carriage drive motor 62 operates to control the printer head assembly 40 in similar steps.

The motors 42 and 62 may comprise, for example, four-phase stepper motors. For example, motor 42 would be advanced by transmitting two phase signals to the motor 42 to advance it through the phases A, B, C and D. Each of the phases A, B, C and D is associated with a discrete signal transmitted from the processor 24. The signals from the processor 24 are connected to magnets in the feed drive motor 42 which are used to advance the platen 46. The printer head assembly 40 is similarly controlled by separate phase signals transmitted from the processor 24 to the carriage drive motor 62.

A problem occurs when the platen 46 or the printer head assembly 40 is manually moved. If the physical position after the manual movement of these movable printing elements does not correspond to the appropriate phase that the processor 24 last transmitted, then the initial characters printed may be distorted.

This problem may best be understood by referring to the graphical representation of the phases of operation shown in FIG. 12. FIG. 12 illustrates a graph 302 which shows the phases of a four-phase stepper motor indicated generally at 304. On the graph 302, four physical positions of the printer elements are shown by dots on the graph access at 306, 308, 310 and 312. Arrows 314, 316, 318 and 320 illustrate phase signals transmitted from the processor 24 to initiate movement in the printer elements.

The problem presented by manual movement of the printer element can best be understood by examining a specific example with reference to FIG. 12. In the conventional operation of, for example, platen 46, the physical locations and the phases would correspond exactly. For example, if the platen 46 was resting at physical position 306, the processor 24 would be transmitting signals corresponding to phase A indicated by arrow 314. Subsequently, the processor 24 would transmit signals corresponding to phase B of operation indicated by arrow 316. The physical position of the platen 46 would then change to physical position 308. In this manner, the processor 24 is capable of sequentially directing the movement of the platen 46 in either direction by advancing or decrementing through the phases indicated by arrows 314, 316, 318 and 320. The processor 24 similarly directs the movement of the other movable printing element, the printer head assembly 40, by transmitting separate phase signals to the carriage drive motor 62.

A problem occurs, however, if manual movement is introduced into the system. For example, assume that the platen 46 is manually moved to physical position 310, while the processor 24 is inactive. When the processor 24 attempts to initiate the printing activity in response to a print command, it will attempt to advance the platen 46 by transmitting phase signals associated with phase B assuming that its last position was phase A associated with arrow 314. Thus, the physical position of the platen 46 resides at position 310 and the phase signals transmitted to the feed drive motor 42 correspond to arrow 316. The signals and the physical positions are therefore out of phase. The result is that the platen 46 will back up to physical position 308. If printing activity is occurring when this back up occurs, the print quality will be distorted.

Prior art printers have solved this problem by allowing the processor 24 and the feed drive motor 42 to be active at all times during the printing operation and between printing operations. In this manner, if there is physical movement of a movable printing element, the phase of the driving motor is changed automatically. This is an effective method of maintaining the printing element and the driving motor in phase. However, this method requires that power be continuously applied to the drive motors while the printer is inactive. This is extremely inefficient as the drive motors are some of the most power consumptive elements of the printer 20.

The printer constructed according to the teachings of the present invention incorporates a phase intelligence system which eliminates the need for maintaining power to the drive motors 42 and 62 while the printer is inactive. In a first embodiment of the phase intelligence system, the phase signals are transmitted to the drive motors for a predetermined period of time prior to the initiation of the printing process. For example, referring to FIG. 12, assume that the physical position of the platen 46 resides at position 308 due to some physical movement while the printer 20 was inactive. According to the first embodiment, the processor 24 would transmit phase signals corresponding to phase A indicated at arrow 314 prior to the beginning of the printing process. In this manner, the platen 46 would back up from physical position 308 to physical position 306 to come into phase with the signals transmitted from processor 24. Only after the change in physical position of the platen had occurred would the printing process begin. In this manner, no distortion of the print quality would occur.

A second embodiment of the phase intelligence system uses a more complex routine prior to the initiation of the printing process. According to this embodiment, the processor 24 would increment through all the possible phase signals and then decrement back through the phase signals prior to the initiation of the printing process. In other words, the processor 24 would initially transmit the phase signals corresponding to phase A or arrow 314, then phase B or arrow 316, phase C or arrow 318, and then phase D or arrow 320. The processor 24 would then transmit phase C or arrow 318, phase B or arrow 316 and finally phase A or arrow 314. All of these transmissions would occur prior to the beginning of the printing process. In this manner, the processor 24 is able to pick up the physical position of the printing element at some point in the initialization sequence and return it to the initial phase 314 and physical position 306 prior to printing.

The more complicated routine of the second embodiment is slightly more time consuming than the first embodiment, but creates a much smoother movement during the initialization sequence. This is especially apparent if the stepper motor has a larger number of phases. For example, if the drive motors 42 or 62 were eight phase motors, the initialization sequence of the first embodiment could result in as much as a four-step jump. However, the more complex initialization sequence described in the second embodiment is capable of picking up the physical position of an eight-phase drive motor much more smoothly.

In operation, the processor 24 will run the phase intelligence printing initialization process if the printer 20 has been inactive for a predetermined period of time. If, for example, the printer has not been active for five seconds, the processor 24 will initialize the phases of the drive motors 42 and 62 in case there was some physical movement during the period that the printer was inoperative. In this manner, the initial characters printed after a period that the printer is inoperative, will not be distorted and there is no requirement that power be continually supplied to the drive motors 42 and 62. In addition, if the printer 20 has not been inactive for the predetermined period of time, the processor 24 will not run the initialization sequence. This timing process saves the time required for the phase initialization sequence when the time between print commands is so short that it is unlikely that physical movement of either of the movable printing elements has occurred.

In summary, the phase intelligence system incorporated into the printer of the present invention allows for the physical position of the platen 46 or the printer head assembly 40 to come into phase with the processor 24 prior to the beginning of printing operations. This process prevents the distortion which may occur if the drive motors have been brought out of phase by physical manipulation of the printing elements while the drive motors were inactive. The drive motors 42 and 62 are brought into phase by either transmitting an initial phase signal to the drive motors for a predetermined period of time prior to the initialization of the printing process, or by sequentially transmitting all of the possible phase signals to the drive motors prior to the beginning of the printing process. Through either of these operations, the physical printing elements are brought into phase with the drive motors and the processor 24 such that there is no distortion of the initial characters printed.

What is claimed is:

1. An improved processor driven ink-jet printer that includes a paper feed drive motor responsive to said processor and a platen operably connected to said drive motor, the improvements consisting of:

an absorbent washer adjacent to one end of said platen;

friction means for holding paper in tight engagement with said platen;

pin feed drive members located on and rotatable with a shaft extending through said platen, each said pin feed drive member having fixed to it a plurality of circumferentially spaced, radially projecting pins for location in holes provided along each edge of continuous form feed paper, whereby roll, sheet and continuous form paper can be used in said printer.

2. Improved paper feed apparatus for a processor driven ink-jet type printer having an ink-jet cartridge, said apparatus also including a paper feed drive motor responsive to said processor and having a case including a paper feed slot and a paper delivery slot, the improvement comprising:

a platen operably connected to said paper feed drive motor;

an elongated paper guide member disposed in juxtaposition with a lower portion of said platen forming a paper guide slot therebetween;

friction means for holding paper in tight engagement with the platen for movement through said guide slot;

a roll paper support member extending generally parallel to and proximate said guide slot for holding a roll of paper wherein a free end thereon can be fed into said guide slot;

pin feed drive members located on and rotatable with a shaft extending through said platen in spaced relationship, each said pin feed drive member having fixed to it a plurality of circumferentially spaced, radially projecting pins thereon for location in holes provided along each edge of continuous form feed paper, whereby roll, sheet and continuous form paper can be used in said printer; and said platen also including an absorbent washer located adjacent to one of said pin-feed drive members.

3. Improved paper feed apparatus for a processor driven printer that includes a paper feed motor responsive to said processor and having a case including a paper feed slot and a paper delivery slot, the improvement comprising:

a platen operably connected to said drive motor by a drive system consisting of only two pulleys, one belt, and one idler;

a drive pulley mounted on a drive shaft of said motor;

a driven pulley mounted on the shaft of said platen;

a continuous, flexible drive belt operably connecting said pulleys; and a highly resilient idler member mounted in a fixed position and in rotational engagement with said drive belt between said pulleys, whereby said idler member exerts a biasing force on said drive belt for eliminating slack in said belt.

4. The apparatus of claim 3, wherein said idler member has durometer of Endur-C.

5. Improved paper feed apparatus for a processor driven printer that includes a paper feed drive motor responsive to said processor and having a case including a paper feed slot and a paper delivery slot, the improvement comprising:

a platen operably connected to said paper feed drive motor;

an elongated paper guide member having upper and lower edges, said member disposed in juxtaposition with a lower portion of said platen forming a paper guide slot therebetween;

an elongated dancer spring, formed in a generally U-shaped configuration, slipped over the upper edge of said paper guide member to maintain tension on roll paper and to prevent inadvertent slack in the paper while maintaining the paper feed;

friction means for holding paper in tight engagement with the platen for movement through said guide slot;

a roll paper support member extending generally parallel to and proximate said guide slot for holding a roll of paper wherein a free end thereon can be fed into said guide slot; and;

pin feed drive members located on and rotatable with a shaft extending through said platen in spaced relationship, each said pin feed drive member having fixed to it a plurality of circumferentially spaced, radially projecting pins thereon for location in holes provided along each edge of continuous form feed paper, whereby roll, sheet and continuous form paper can be used in said printer.

6. The paper feed apparatus of claim 5, wherein said dancer spring has an inside dimension across its width greater than the thickness of the guide member, so as to permit the dancer spring to move either toward or away from the paper roll as the paper is drawn thereover.

* * * * *

UNITED STATES PATENT AND TRADEMARK OFFICE

CERTIFICATE OF CORRECTION

PATENT NO. : 5,092,690
DATED : Mar. 3, 1992
INVENTOR(S) : Thomas R. Grimm

It is certified that error appears in the above-indentified patent and that said Letters Patent is hereby corrected as shown below:

On the title page:

Item [75] The following three persons should be deleted from the inventors.

Donald J. Arndt of Georgetown, Texas;
Mark A. Rendon of Belton, Texas; and
Dan Dodson of Temple Texas.

Signed and Sealed this
Twenty-second Day of June, 1993

*Attest:*

*Attesting Officer*

Michael K. Kirk

MICHAEL K. KIRK

*Acting Commissioner of Patents and Trademarks*